United States Patent [19]

Vierling

[11] Patent Number: 4,644,905

[45] Date of Patent: Feb. 24, 1987

[54] METHOD OF PRODUCING STEAM

[76] Inventor: Donald E. Vierling, 11309 Toledo Dr., Austin, Tex. 78759

[21] Appl. No.: 817,268

[22] Filed: Jan. 8, 1986

[51] Int. Cl.[4] ..... F22B 1/02

[52] U.S. Cl. ..... 122/31 A; 122/5.5 A; 126/360 A

[58] Field of Search ..... 126/360 R, 360 A; 122/31 A, 5.5 A

[56] References Cited

U.S. PATENT DOCUMENTS

| | | | |
|---|---|---|---|
| 971,724 | 10/1910 | Brunler | 126/360 A X |
| 4,141,343 | 2/1979 | Awano et al. | 126/360 A |
| 4,308,855 | 1/1982 | Schallert | 126/360 A |

FOREIGN PATENT DOCUMENTS

| | | | |
|---|---|---|---|
| 1166327 | 11/1958 | France | 122/31 A |

*Primary Examiner*—Edward G. Favors
*Attorney, Agent, or Firm*—Martin J. Carroll

[57] ABSTRACT

Steam suitable for use in conventional apparatus is produced by burning hydrogen to oxygen to generate very high temperature steam which passes through a pool of water to cool it and produce additional steam with the final steam produced having the desired temperature. Water is fed into the pool at a controlled rate during the burning of the hydrogen and oxygen to maintain the level of the pool within predetermined limits.

6 Claims, 1 Drawing Figure

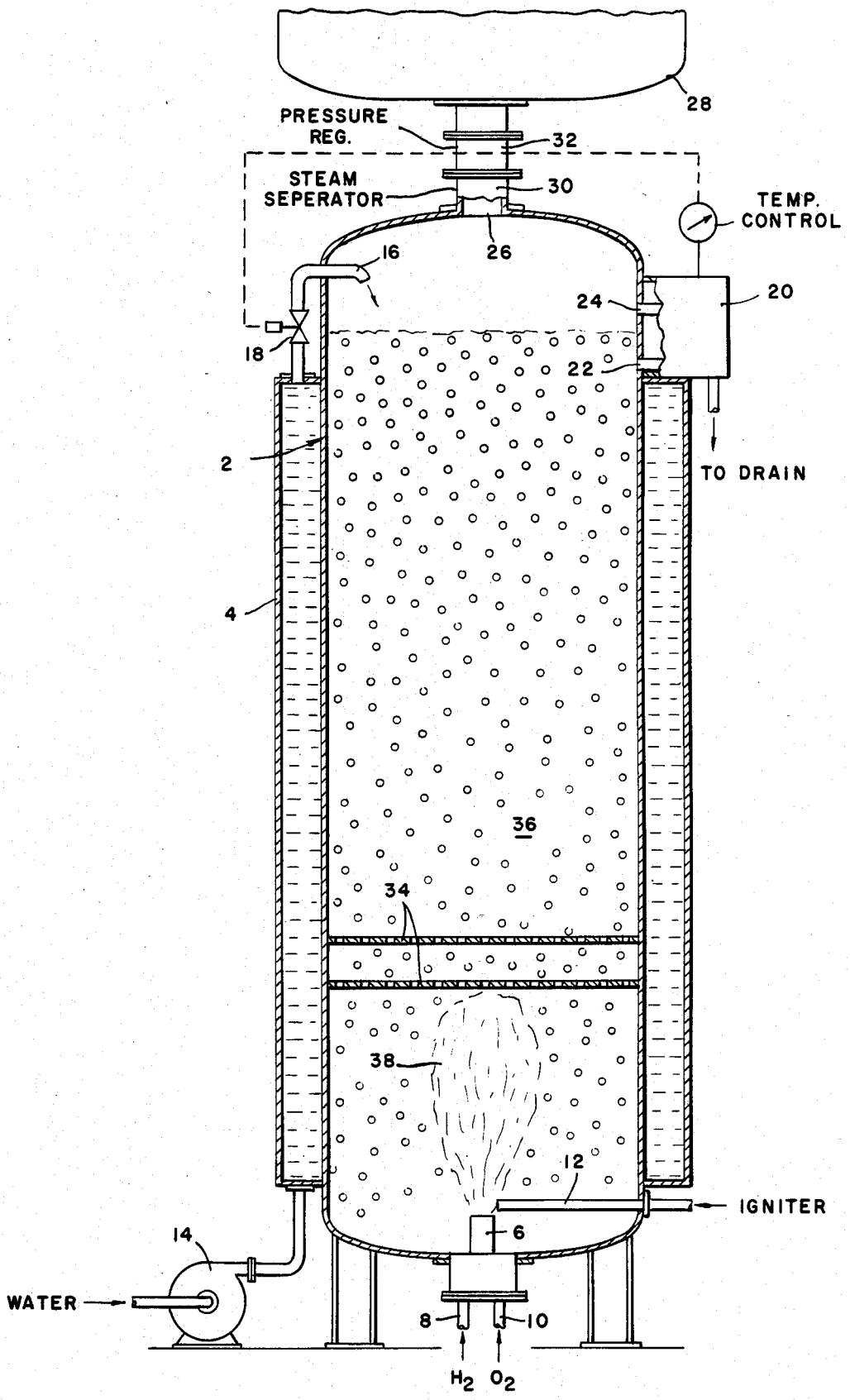
28
PRESSURE REG.
32
STEAM SEPERATOR
30
TEMP. CONTROL
16
26
24
20
18
22
2
TO DRAIN
4
36
34
38
12
IGNITER
14
6
WATER
8
10
$H_2$
$O_2$

METHOD OF PRODUCING STEAM

This invention relates to a method of producing steam and more particularly for producing steam utilizing hydrogen, oxygen and water.

Steam has been produced by burning hydrogen to produce steam and passing the flame and/or produced steam through sprays of water which lowers the temperature of the produced steam and turns the sprays of water into steam. This produces an end product which has a temperature suitable for handling in materials now available. Apparatus suitable for this purpose is shown in U.S. Patents Robertson et al. No. 3,101,592, Oda et al No. 3,993,431, Steinfeld et al. No. 4,377,067, and Schurmer et al No. 4,475,883 and in Japanese Pat. No. 51-18300 dated February 1976. In each of these patents a vessel is provided into which the hydrogen and oxygen is introduced and burned and then passes into contact with a spray or sprays of water. It will be understood that the vessel is under a high pressure and that the steam produced by oxidation is at a very high temperature about 4000°. Thus the oxygen and hydrogen must be introduced at high pressure and there is danger of some of the products of combustion impinging on the walls of the vessel causing damage thereto. While the streams of water cool the products of combustion there is still a period of time when they are at the extremely high temperature. This also causes damage to and shortens the life of the vessel.

It is therefore an object of my invention to provide a method of producing steam from oxygen, hydrogen and water that is more efficient and less destructive to the apparatus used.

This and other objects are more apparent after referring to the following specification and attached drawing in which the single FIGURE is a schematic view of the apparatus of my invention.

Referring more particularly to the drawing, reference numeral 2 indicates a combustion chamber having a cooling jacket 4 surrounding it. A burner 6 is mounted on the bottom of the chamber 2 and extends upwardly into the chamber. Hydrogen is provided to the burner 6 through tube 8 and oxygen through tube 10. An ignition electrode 12 extends into the combustion chamber 2 at the burner 6. Water from a pump 14 is passed through the jacket 4 around the chamber 2 and through a tube 16 into the chamber 2. A control valve 18 located in tube 16 is controlled from a conventional liquid level controller 20 having a minimum level 22 and a maximum level 24. A steam outlet 26 connects chamber 2 to a turbo-generator 28 or other means for utilizing the steam. A steam separator 30 and/or pressure regulator 32 may be provided in outlet 26. A screen or screens 34 may be provided in the pool of water 36 above the combustion zone 38. A temperature control 40 may be provided in outlet 26 to shut off the flow of hydrogen and oxygen when the temperature falls below a predetermined level.

In operation, water is fed into chamber 2 until it reaches level 24 when it will be shut off by closing of valve 18. The burner 6 is then ignited by igniter 12 causing the hydrogen and oxygen to burn within combustion zone 38 beneath the top surface of the pool of water. This procedure steam at a temperature of over 4000° F. In order to cool the steam to the desired temperature it is passed through the pool of water 36. The height of the pool is such that the exiting steam is about 750° F. at about 3500 lbs. per square inch in one particular embodiment. The combustion zone 38 is a large bubble under pressure entirely surrounded by water. This steam bubbles turbulently through the pool of water converting water to additional steam bubbles which in turn bubbles through additional water and converting it to steam. This operation proceeds through the pool of water 36 until steam leaves the water at the desired temperature and pressure. This operation is very efficient without the screens 34, but the screen increases the efficiency by breaking up the bubbles into smaller bubbles. The water level drops during the operation and when it reaches minimum level 22 the control 20 operates to open valve 18 and introduce additional water until level 24 is reached when the controller closes valve 18. A number of chambers 2 may be placed in parallel to generate the desired quantity of steam. Since the combustion products mix with the water faster than when passing through sprays they will not impinge on the wall of chamber 2, thus preventing damage to the walls.

While it is preferred that the burner be located as shown, it is only necessary that the burner outlet be below the surface of the water.

While one embodiment has been shown and described it will be understood that other adaptations and modifications may be made within the scope of the following claims.

I claim:

1. The method of producing steam at temperatures suitable for handling in available materials which comprises providing a pool of water of substantial depth, burning hydrogen with oxygen beneath the surface to generate steam at extremely high temperatures, said generated steam mixing with said water to lower said generated steam temperature and form additional steam from said water, providing additional water to said pool, and controlling the amount of added water to maintain the top level of said pool of water above the burning hydrogen so as to provide steam at the desired temperature.

2. The method of claim 1 in which the top of said pool of water is maintained between a minimum and maximum level.

3. The method of claim 1 in which the pool of water is contained in a chamber, and said hydrogen and oxygen are introduced vertically into the bottom of said chamber.

4. The method of claim 3 including the step of passing said added water around said chamber to cool the walls thereof before being introduced into said chamber.

5. The method of producing steam according to claim 1 in which the temperature of the generated steam of combustion is at least about 4000° F.

6. The method of producing steam according to claim 5 in which the steam produced by the mixing of products of combustion and water is fed to a turbo generator.

* * * * *